US009754751B2

(12) United States Patent
Oh

(10) Patent No.: US 9,754,751 B2
(45) Date of Patent: Sep. 5, 2017

(54) MOLDED CASE CIRCUIT BREAKER

(71) Applicant: LSIS CO., LTD., Anyang-si, Gyeonggi-do (KR)

(72) Inventor: Kyunghwan Oh, Anyang-si (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/981,670

(22) Filed: Dec. 28, 2015

(65) Prior Publication Data

US 2016/0268085 A1 Sep. 15, 2016

(30) Foreign Application Priority Data

Mar. 11, 2015 (KR) ..... 10-2015-0033872

(51) Int. Cl.

| | |
|---|---|
| ***H01H 1/64*** | (2006.01) |
| ***H01H 1/66*** | (2006.01) |
| ***H01H 9/02*** | (2006.01) |
| ***H01H 9/06*** | (2006.01) |
| ***H01H 13/00*** | (2006.01) |
| ***H01H 19/04*** | (2006.01) |
| ***H01H 19/08*** | (2006.01) |

(Continued)

(52) U.S. Cl.

CPC ..... *H01H 71/025* (2013.01); *H01H 71/74* (2013.01); *H01H 71/7427* (2013.01); *H01H 71/7463* (2013.01); *H01H 2071/7481* (2013.01)

(58) Field of Classification Search

CPC .. H01H 1/64; H01H 1/66; H01H 9/02; H01H 9/06; H01H 13/00; H01H 19/04; H01H 19/08; H01H 21/00; H01H 13/50; H01H 71/00; H01H 71/02; H01H 71/025; H01H 71/10; H01H 2009/20; H01H 2223/00; H01H 2071/7481; H01H 71/74; H01H 71/7427; H01H 71/7463

USPC ..... 200/293, 43.01, 43.08, 43.11, 43.22, 200/19.22, 19.3

See application file for complete search history.

(56) References Cited

U.S. PATENT DOCUMENTS

| | | | |
|---|---|---|---|
| 5,467,069 | A | 11/1995 | Payet-Burin et al. |
| 5,821,485 | A | 10/1998 | Singer et al. |
| 6,255,925 | B1 | 7/2001 | DiMarco et al. |

FOREIGN PATENT DOCUMENTS

| | | |
|---|---|---|
| KR | 20-1999-0016828 | 5/1999 |
| KR | 20-2000-0015237 | 7/2000 |

OTHER PUBLICATIONS

Korean Intellectual Property Office Application No. 10-2015-0033872, Office Action dated Jun. 15, 2016, 4 pages.

(Continued)

*Primary Examiner* — Anthony R. Jimenez

(74) *Attorney, Agent, or Firm* — Lee Hong Degerman Kang & Waimey

(57) ABSTRACT

Disclosed is a molded case circuit breaker including a case configured to accommodate an element for trip, an upper cover detachable attached to the case, a dial configured to include a fixing plate, which is provided to protrude along an outer circumference surface thereof, and a first stopper disposed under the fixing plate, a crossbar moved by the dial, a first dial fitting hole provided in the upper cover for the dial to be fitted into the first dial fitting hole, and a dial rotation adjusting unit provided in the first dial fitting hole and fitted between the fixing plate and the first stopper to guide a rotation of the dial, the dial rotation adjusting unit including a plurality of fitting grooves arranged at certain intervals.

(Continued)

The first stopper is fitted into and fixed to the plurality of fitting grooves according to the rotation of the dial.

4 Claims, 7 Drawing Sheets

(51) Int. Cl.

| | |
|---|---|
| ***H01H 21/00*** | (2006.01) |
| ***H01H 71/02*** | (2006.01) |
| ***H01H 71/74*** | (2006.01) |

(56) References Cited

OTHER PUBLICATIONS

European Patent Office Application Serial No. 15203036.7, Search Report dated Feb. 29, 2016, 7 pages.

MOLDED CASE CIRCUIT BREAKER

CROSS-REFERENCE TO RELATED APPLICATION

Pursuant to 35 U.S.C. §119(a), this application claims the benefit of earlier filing date and right of priority to Korean Patent Application No. 10-2015-0033872, filed on Mar. 11, 2015, the contents of which are hereby incorporated by reference herein in its entirety.

BACKGROUND OF THE DISCLOSURE

1. Field of the Disclosure

The present disclosure relates to a molded case circuit breaker, and particularly, to a molded case circuit breaker in which by improving a structure of a dial included in the molded case circuit, a rated current is adjusted without an error, a whole structure is simplified, the manufacturing cost is reduced, and the dial fixed to the molded case circuit breaker is prevented from easily deviating from the molded case circuit.

2. Background of the Disclosure

Generally, a molded case circuit breaker (MCCB) is installed on a switchboard among power distribution equipment provided in factories, buildings, and/or the like. In a non-load state, the molded case circuit breaker acts as a switching device that supplies or cuts off power to a load. While a load is being used, when a high current higher than a load current flows due to an abnormal condition that occurs in a load electric circuit, the molded case circuit breaker acts as a circuit breaker that supplies or cuts off power supplied from a power source to a load, for protecting a wire of an electric circuit and elements of the load.

As described above, when an error occurs in a circuit, the molded case circuit breaker quickly breaks an electric circuit, thereby preventing a wiring and a connection device from being damaged or preventing fire.

FIG. 1 illustrates a schematic configuration of a related art molded case circuit breaker.

As illustrated in FIG. 1, the related art molded case circuit breaker includes: a fixed contact 1 that is supplied with power through a general cable and transfers the power to a load; a movable contact 2 that is brought in contact with or separated from the fixed contact 1 and applies the power to the fixed contact 1; an extinguishing apparatus 3 that extinguishes an arc when cutting off a fault current; an opening/closing mechanism 4 that opens or closes an electric line; a detection mechanism 5 that detects an abnormal current; and a case 6 that includes a plurality of elements disposed therein.

FIG. 2 is a schematic perspective view illustrating the detection mechanism 5 included in the related art molded case circuit breaker. FIG. 3 is an exploded perspective view illustrating a detection mechanism cover included in the detection mechanism 5. FIG. 4 illustrates a dial for adjusting a rated current of the related art. FIG. 5 illustrates a schematic plan view of a dial mount. FIG. 6 illustrates a schematic perspective view of a trip mechanism and a detection unit.

As illustrated in FIGS. 2 to 6, the detection mechanism 5 may include a detection mechanism cover 5*a*, a detection mechanism case 5*b* where a plurality of elements are disposed, a trip mechanism 5*c* that is tripped when a fault current is applied to the molded case circuit breaker, and a detection unit 5*d* that detects the fault current. A dial 5*e*, which displays and adjusts a rated current, and a dial mount 5*f* that fixes the dial 5*e* are disposed in the detection mechanism cover 5*a*.

In this case, the dial 5*e* includes a maximum stopper 5*e*-1 and a minimum stopper 5*e*-2, which limit a rotation of the dial 5*e*, and a moving bar 5*e*-3 that moves a crossbar 12 to adjust the trip mechanism 5*c*.

Moreover, the dial mount 5*f* includes a dial coupling hole 5*f*-1 and a fixing stopper 5*f*-2. The maximum stopper 5*e*-1 and the minimum stopper 5*e*-2 are brought in contact with the fixing stopper 5*f*-2 according to the dial 5*e* being rotated with the dial 5*e* being fitted into the dial coupling hole 5*f*-1, and thus, the rated current of the molded case circuit breaker is adjusted.

Therefore, when a fault current equal to or higher than the rated current which has been adjusted through the dial 5*e* flows into the molded case circuit breaker, a bimetal 11 is bent toward the crossbar 12 due to heat generated by a heater 10 and rotates the crossbar 12 by pushing an inclined surface of the crossbar 12 to release a restraint of a shooter 13, thereby enabling the opening/closing mechanism 4.

In the molded case circuit breaker that is configured and operates as described above, the dial 5*e* is rotated by adjusting the rated current. When the dial 5*e* is counter-clockwise rotated in a state where the rated current is set by 100%, the crossbar 12 is moved to the left (a direction toward the bimetal 11) through the moving bar 5*e*-3 included in the dial 5*e*, and thus, the inclined surface of the crossbar 12 is moved to the left (the direction toward the bimetal 11), whereby a size of a gap between the crossbar 12 and the bimetal 11 is adjusted and thus a value of the rated current is variously set.

However, as described above, in the dial 5*e* of the related art for adjusting the rated current of the molded case circuit breaker, it is difficult to accurately match the dial 5*e* with a desired value of the rated current when rotating the dial 5*e*.

Moreover, there is no separate element for fixing the dial 5*e* to an adjusted position, and thus, when an impact is applied from the outside to the molded case circuit breaker, the dial 5*e* is rotated to a certain degree, whereby a rated current value of the molded case circuit breaker is changed. For this reason, despite a fault current being applied to the molded case circuit breaker, a trip operation cannot be performed.

SUMMARY OF THE DISCLOSURE

Therefore, an aspect of the detailed description is to provide a molded case circuit breaker in which by improving a structure of a dial included in the molded case circuit, a rated current is adjusted without an error, a whole structure is simplified, the manufacturing cost is reduced, and the dial fixed to the molded case circuit breaker is prevented from easily deviating from the molded case circuit.

To achieve these and other advantages and in accordance with the purpose of this specification, as embodied and broadly described herein, a molded case circuit breaker includes: a case configured to accommodate an element for trip; an upper cover detachable attached to the case; a dial configured to include a fixing plate, which is provided to protrude along an outer circumference surface thereof, and a first stopper disposed under the fixing plate; a crossbar moved by the dial; a first dial fitting hole provided in the upper cover for the dial to be fitted into the first dial fitting hole; and a dial rotation adjusting unit provided in the first dial fitting hole and fitted between the fixing plate and the first stopper to guide a rotation of the dial, the dial rotation adjusting unit including a plurality of fitting grooves arranged at certain intervals, wherein the first stopper is fitted into and fixed to the plurality of fitting grooves according to the rotation of the dial.

Moreover, the dial rotation adjusting unit may include a rotation guide plate provided to protrude to inside the upper cover and fitted between the fixing plate and the first stopper to guide the rotation of the dial. The plurality of fitting grooves may be provided in the rotation guide plate to be spaced apart from each other by a certain interval, and the first stopper may be fitted into and fixed to the plurality of fitting grooves according to the rotation of the dial.

Moreover, the molded case circuit breaker may further include a moving bar disposed under the first stopper to move the crossbar according to the rotation of the dial; and a moving bar fitting hole provided in the first dial fitting hole for the moving bar to be fitted into the moving bar fitting hole as one body.

Moreover, the molded case circuit breaker may further include a first stopper moving space provided between the first stopper and the moving bar, wherein the rotation guide plate may be fitted between the fixing plate and the first stopper, and when the dial rotates, the first stopper may be bent in a direction toward the moving bar.

Moreover, the molded case circuit breaker may further include: an auxiliary cover disposed on the upper cover; a second stopper provided in the fixing plate; a second dial fitting hole provided in the auxiliary cover to correspond to the first dial fitting hole; and a moving groove provided in the second dial fitting hole for the second stopper to be fitted into the moving groove and moved, wherein the moving groove may be disposed to correspond to a portion except the moving bar fitting hole and a peripheral portion thereof.

The fitting groove may be disposed to correspond to a lower side of the moving groove, and when the dial rotates with the auxiliary cover being coupled to the upper cover, the second stopper may be moved in a state of being fitted into the moving groove, and simultaneously, the first stopper may be fitted into and fixed to the fitting groove.

As described above, in the molded case circuit breaker according to an exemplary embodiment of the present invention, the first stopper may be included in the dial, the first stopper may be fitted into the fitting groove provided in the dial rotation adjusting unit according to a rotation of the dial, and thus, the dial may be stably fixed to a position corresponding to a desired rated current value of the molded case circuit breaker. Therefore, the rated current value may be accurately displayed to the outside, and moreover, the dial may move to a certain degree due to an external impact to change the rated current value, thereby preventing a malfunction of the molded case circuit breaker from being performed.

Moreover, the dial rotation adjusting unit may be provided in the upper cover and may adjust a rotation of the dial without a separate apparatus for fixing the dial, and thus, a whole structure is simplified, the manufacturing cost is reduced, and a time taken in manufacturing the molded case circuit breaker is shortened.

Moreover, the auxiliary cover may be coupled to the upper end of the upper cover, and moreover, the moving groove may be provided in order for the second stopper to be fitted into the auxiliary cover and moved. Also, the moving groove may be provided at a portion except the moving bar fitting hole and a periphery of the moving bar fitting hole. Therefore, when the auxiliary cover is coupled to the upper cover, the dial is prevented from being further moved toward the moving bar fitting hole in a state where the dial rotates to a certain degree from the moving bar fitting hole, and thus, the auxiliary cover prevents the dial from deviating from a normal position to the outside.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings.

DETAILED DESCRIPTION OF THE DISCLOSURE

Description will now be given in detail of the exemplary embodiments, with reference to the accompanying drawings. For the sake of brief description with reference to the drawings, the same or equivalent components will be provided with the same reference numbers, and description thereof will not be repeated.

Hereinafter, a molded case circuit breaker according to an exemplary embodiment of the present invention will be described in detail with reference to the accompanying drawings.

Figure 1:
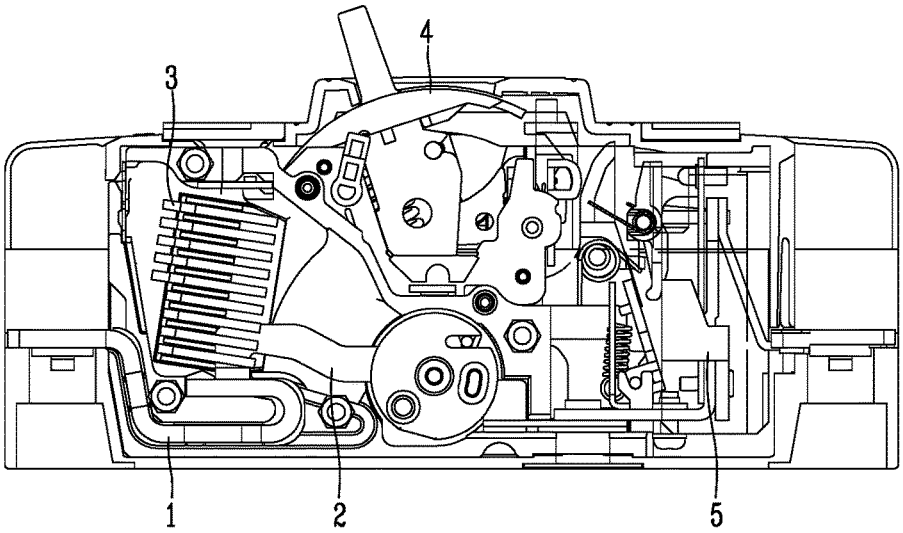
FIG. 1 RELATED ART
FIG. 1 is a diagram illustrating a schematic configuration of a related art molded case circuit breaker.
Figure 2:
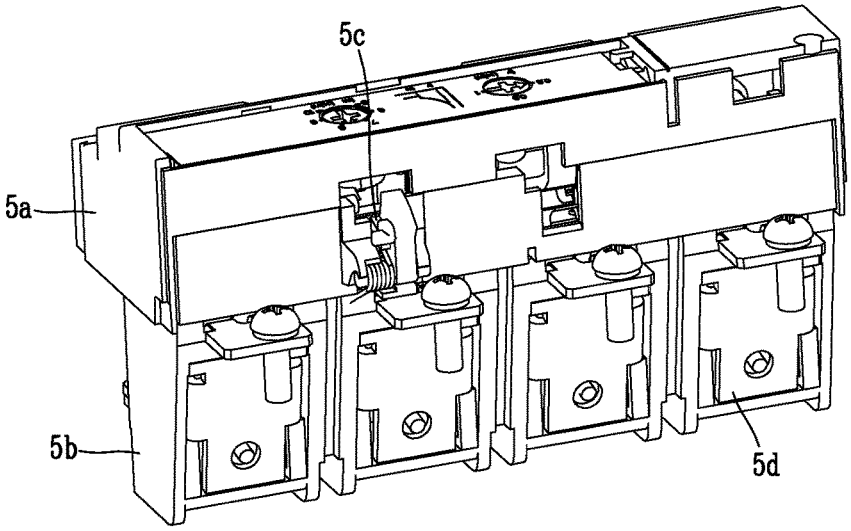
FIG. 2 RELATED ART
FIG. 2 is a schematic perspective view illustrating a detection mechanism included in the related art molded case circuit breaker.
Figure 3:
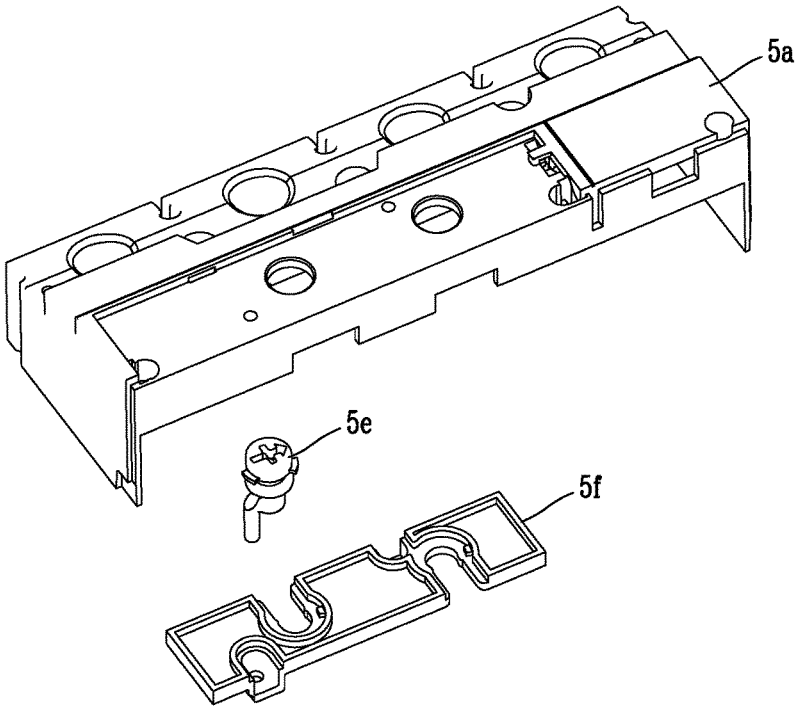
FIG. 3 RELATED ART
FIG. 3 is an exploded perspective view illustrating a detection mechanism cover included in the detection mechanism.
Figure 4:
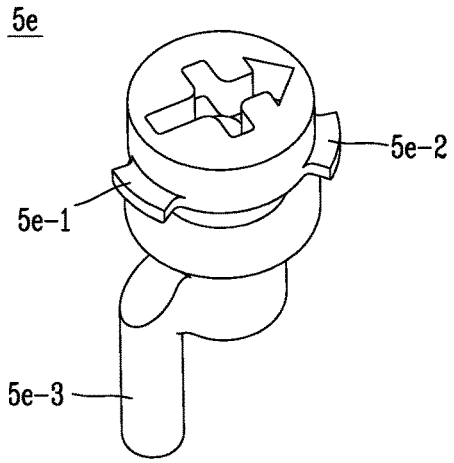
FIG. 4 RELATED ART
FIG. 4 is a perspective view of a dial for adjusting a rated current of the related art.
Figure 5:
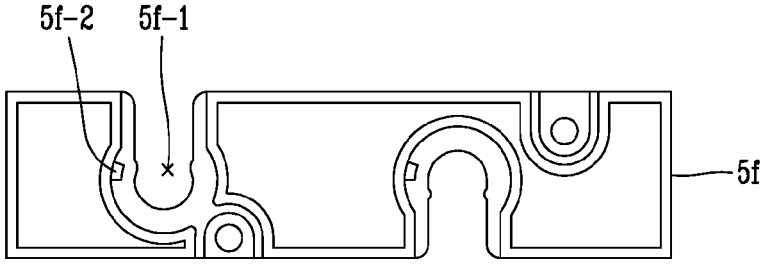
FIG. 5 RELATED ART
FIG. 5 is a schematic plan view of a dial mount.
Figure 6:
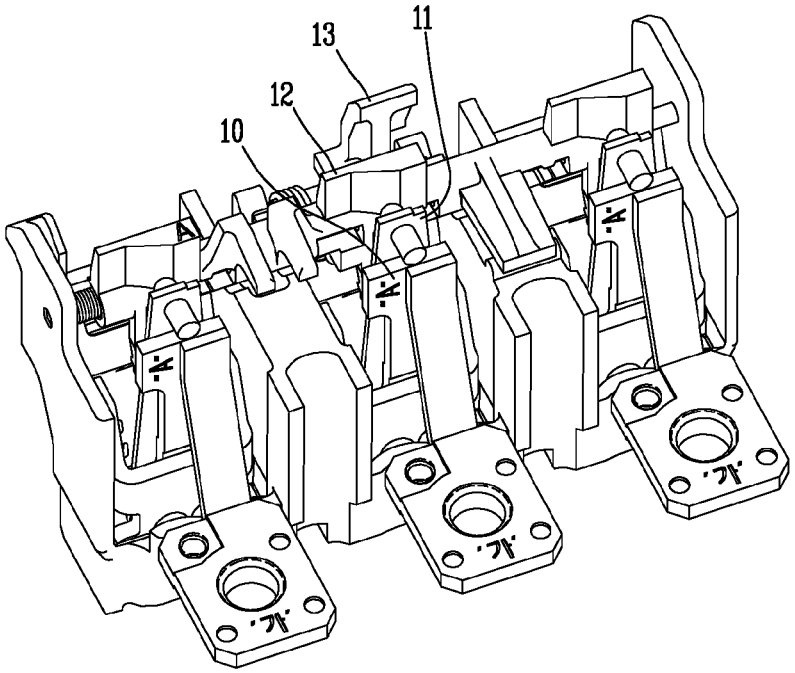
FIG. 6 RELATED ART
FIG. 6 is a schematic perspective view of a trip mechanism and a detection unit.
Figure 7:
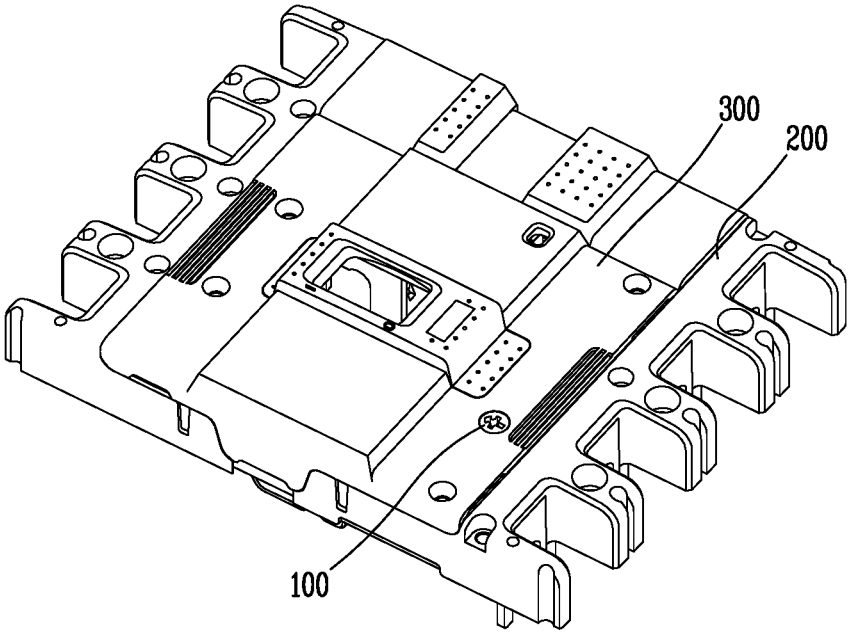
FIG. 7 is a schematic perspective view illustrating a state where a dial is fitted into an upper cover and an auxiliary cover included in a molded case circuit breaker according to an exemplary embodiment of the present invention.
Figure 8:
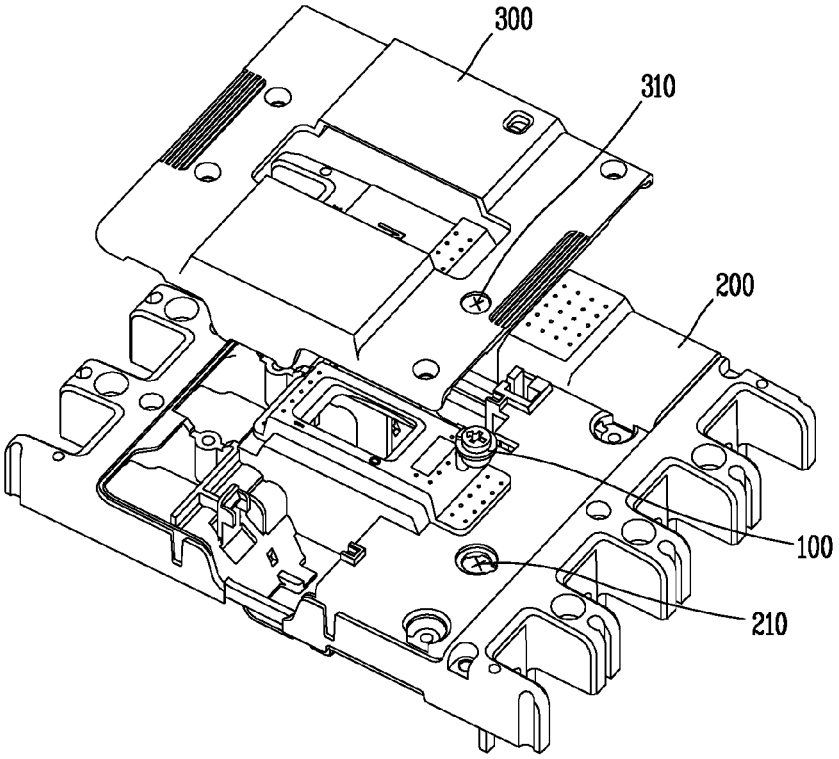
FIG. 8 is an exploded perspective view of the upper cover, the auxiliary cover, and the dial included in the molded case circuit breaker according to an exemplary embodiment of the present invention.

As illustrated in FIGS. 7 and 8, the molded case circuit breaker according to an exemplary embodiment of the present invention may include a case (not shown) that accommodates a plurality of trip elements and an upper cover 200 that is detachably attached to the case and into which a dial 100 for adjusting a rated current is fitted.

A plurality of trip elements such as a heater (not shown), a bimetal (not shown), a crossbar (not shown), and/or the like may be provided in the case. When a fault current flows into the molded case circuit breaker, the bimetal may be bent toward the crossbar by heat generated by a heater, and thus, the bimetal may push an inclined surface of the crossbar to rotate the crossbar, whereby a restraint of a shooter connected thereto is released and thus a trip operation of an opening/closing mechanism (not shown) including a handle and/or the like may be performed.

In this case, the rated current of the molded case circuit breaker may be adjusted by adjusting an interval between the bimetal and the crossbar. The interval between the bimetal and the crossbar may be adjusted through the dial 100.

That is, a worker may rotate the dial 100 by using a display unit 150 to move the crossbar toward the bimetal through the dial 100, thereby adjusting the interval between the bimetal and the crossbar to adjust a value of the rate current with which the molded case circuit breaker operates.

Figure 9:
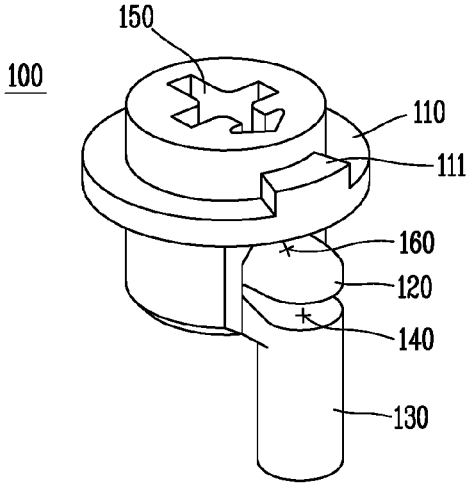
FIG. 9 is a perspective view illustrating the dial included in the molded case circuit breaker according to an exemplary embodiment of the present invention.
Figure 10:
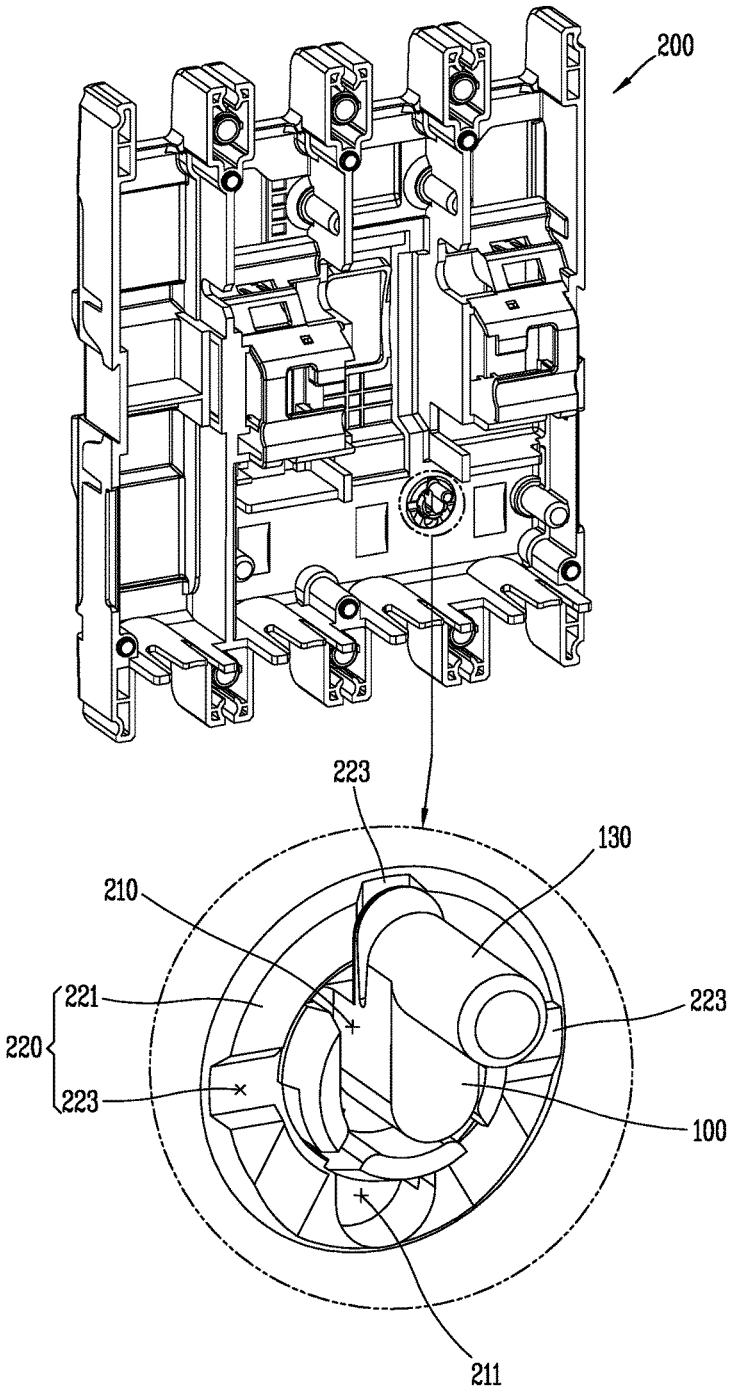
FIG. 10 is a partially enlarged view illustrating a state where the dial included in the molded case circuit breaker according to an exemplary embodiment of the present invention is fitted into the upper cover and the auxiliary cover.

In this case, as illustrated in FIGS. 9 and 10, the dial 100 may include a fixing plate 110, which is provided to protrude to an outer side along an outer circumference surface of the dial 100, and a first stopper 120 that is disposed under the fixing plate 110.

The fixing plate 110 may be fitted into a first dial fitting hole 210, which is included in the upper cover 200 to be described below, and may support the dial 100 to be fixed to the upper cover 200.

The first stopper 120 may be provided under the fixing plate 110 to protrude to an outer side and may be fitted into a dial rotation adjusting unit 220 included in the upper cover 200, thereby enabling the dial 100 to be accurately fixed to a position corresponding to a rated current value which is to be set in the molded case circuit breaker.

The first dial fitting hole 210 may be provided in the upper cover 200 in order for the dial 100 to be fitted into and fixed to the first dial fitting hole 210, and thus, the dial 100 may rotate in a state of being fitted into the first dial fitting hole 210, thereby adjusting the rated current.

Moreover, the dial rotation adjusting unit 220 may be provided in the first dial fitting hole 210 (in the upper cover 200 where the first dial fitting hole 210 is provided). The dial rotation adjusting unit 220 may be fitted between the fixing plate 110 and the first stopper 120, and a plurality of fitting grooves 223 which the first stopper 120 is fitted into and fixed to according to a rotation of the dial 100 may be provided in the upper cover 200.

In this case, the dial rotation adjusting unit 220 may include a rotation guide plate 221 and a fitting groove 223.

The rotation guide plate 221 may be provided to protrude to an inner side of the upper cover 220. The rotation guide plate 221 may be fitted (160) between the fixing plate 110 and the first stopper 120 to guide a rotation of the dial 100.

The fitting groove 223 may be provided in plurality, and the plurality of fitting grooves 223 may be arranged at certain intervals along the rotation guide plate 221. When the dial 100 rotates with the rotation guide plate 221 being fitted (160) between the fixing plate 110 and the first stopper 1220, the first stopper 120 may be fitted into and fixed to the fitting groove 223, and thus, the dial 100 may be fixed to a position corresponding to a desired rated current.

In this case, a position of the fitting groove 223 may correspond to a maximum rated current value, a minimum rated current value, or a medium rated current value, but is not limited thereto. In other exemplary embodiments, the fitting groove 223 may be disposed at various positions requiring a more accurate rated current value.

The moving bar 130 may be disposed under the first stopper 120, and a moving bar fitting hole 211 may be further provided in order for the moving bar 130 to be fitted into the first dial fitting hole 120 as one body.

Moreover, a first stopper moving space 140 may be provided between the first stopper 120 and the moving bar 130.

The moving bar 130 may be disposed to protrude under the first stopper 120. When the dial 100 rotates according to manipulation of a user with the moving bar 130 being fitted into the moving bar fitting hole 211, the moving bar 130 may push the crossbar toward the bimetal to adjust an interval between the crossbar and the bimetal, thereby adjusting the rated current of the molded case circuit breaker.

The first stopper moving space 140 may be provided between the first stopper 120 and the moving bar 130. When the dial 100 rotates with the rotation guide plate 221 being fitted between the fixing plate 110 and the first stopper 120, the first stopper 120 may be bent at a certain angle toward the first stopper moving space 140 through the rotation guide plate 221, and when the first stopper 120 is located in the fitting groove 223, the first stopper 120 may restore to an original position with an elastic force and may simultaneously be fitted into the fitting groove 223, whereby the dial 100 may be fixed to a position corresponding to a rated current which is to be set in the molded case circuit breaker.

In this case, the dial 100 may be formed of at least one of various materials such as rubber and/or the like having an elastic force, and thus, the first stopper 120 may be easily bent through the rotation guide plate 221 and then may easily restore to an original position.

Figure 11:
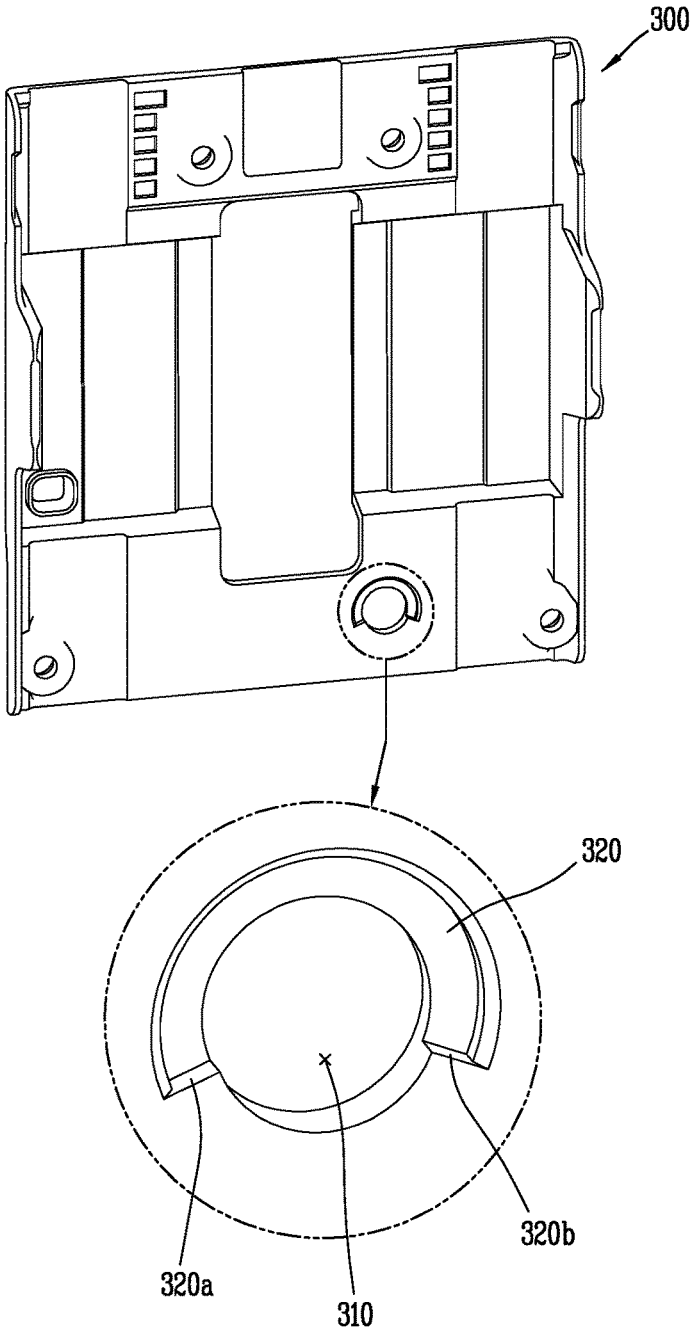
FIG. 11 is a perspective view illustrating the auxiliary cover included in the molded case circuit breaker according to an exemplary embodiment of the present invention.

In addition, as illustrated in FIG. 11, an auxiliary cover 300 may be further provided on the upper cover 200.

The auxiliary cover 300 may be detachably attached to an upper end of the upper cover 200 to adjust a degree of rotation of the dial 100, thereby preventing the dial 100 from deviating from a fixed position to the outside.

In this case, a second dial fitting groove 310 may be provided at a position, corresponding to the first dial fitting groove 210, in the auxiliary cover 300. A moving groove 320 may be provided in the second dial fitting hole 310 (in the auxiliary cover 300 where the second dial fitting hole 310 is provided) in order for a second stopper 111 to be moved to an inner side along the second dial fitting groove 310 in a state of being fitted into the second dial fitting groove 310. The second stopper 111 may be provided in the fixing plate 110.

Therefore, when the auxiliary cover 300 is fitted into an upper end of the upper cover 200 with the dial 100 being fitted into the first dial fitting hole 210 which is provided in the upper cover 200, the dial 100 may be fitted into the second dial fitting hole 310, and simultaneously, the second stopper 111 may be fitted into the moving groove 320.

In this case, when the dial 100 rotates according to manipulation of the user with the second stopper 111 being fitted into the second dial fitting hole 310, the second stopper 111 may move along the moving groove 320, and thus, a position of the dial 100 may be adjusted. Although the dial 100 moves along the moving groove 320, since the dial 100 may be hanged on both ends 320*a* and 320*b* of the moving groove 320, the dial 100 may not rotate in a direction toward the moving bar fitting hole 211 with the auxiliary cover 300 being fitted into the moving groove 320, thereby preventing the dial 100 from deviating from a normal position.

According to an exemplary embodiment of the present invention, the first stopper 120 may be included in the dial 100, the first stopper 120 may be fitted into the fitting groove 223 provided in the dial rotation adjusting unit 220 according to a rotation of the dial 100, and thus, the dial 100 may be stably fixed to a position corresponding to a desired rated current value of the molded case circuit breaker. Therefore, the rated current value may be accurately displayed to the outside, and moreover, the dial 100 may move to a certain degree due to an external impact to change the rated current value, thereby preventing a malfunction of the molded case circuit breaker from being performed.

Moreover, the dial rotation adjusting unit 220 may be provided in the upper cover 200 and may adjust a rotation of the dial 100 without a separate apparatus for fixing the dial 100, and thus, a whole structure is simplified, the manufacturing cost is reduced, and a time taken in manufacturing the molded case circuit breaker is shortened.

Moreover, the auxiliary cover 300 may be coupled to the upper end of the upper cover 200, and moreover, the moving groove 320 may be provided in order for the second stopper 111 to be fitted into the auxiliary cover 300 and moved. Also, the moving groove 320 may be provided at a portion except the moving bar fitting hole 211 and a periphery of the moving bar fitting hole 211. Therefore, when the auxiliary cover 300 is coupled to the upper cover 200, the dial 100 is prevented from being further moved toward the moving bar fitting hole 211 in a state where the dial 100 rotates to a certain degree from the moving bar fitting hole 211, and thus, the auxiliary cover 300 prevents the dial 100 from deviating from a normal position to the outside.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A molded case circuit breaker comprising:

a case configured to accommodate an element for trip;

an upper cover detachably attached to the case;

a dial configured to include a fixing plate, which is provided to protrude along an outer circumference surface thereof, and a first stopper disposed under the fixing plate;

a crossbar moved by the dial;

a first dial fitting hole provided in the upper cover for the dial to be fitted into the first dial fitting hole;

a dial rotation adjusting unit provided in the first dial fitting hole and fitted between the fixing plate and the first stopper to guide a rotation of the dial, the dial rotation adjusting unit including a plurality of fitting grooves arranged at certain intervals;

a moving bar disposed under the first stopper to move the crossbar according to the rotation of the dial;

a moving bar fitting hole provided in the first dial fitting hole for the moving bar to be fitted into the moving bar fitting hole as one body; and a first stopper moving space provided between the first stopper and the moving bar, wherein the first stopper is fitted into and fixed to at least one fitting groove of the plurality of fitting grooves according to the rotation of the dial; and wherein a rotation guide plate is fitted between the fixing plate and the first stopper, and when the dial rotates, the first stopper is bent in a direction toward the moving bar.

2. The molded case circuit breaker of claim 1, wherein the dial rotation adjusting unit comprises the rotation guide plate provided to protrude to inside the upper cover and is fitted between the fixing plate and the first stopper to guide the rotation of the dial, the plurality of fitting grooves are provided in the rotation guide plate to be spaced apart from each other by a certain interval.

3. The molded case circuit breaker of claim 1, further comprising:

an auxiliary cover disposed on the upper cover;

a second stopper provided in the fixing plate;

a second dial fitting hole provided in the auxiliary cover to correspond to the first dial fitting hole; and a moving groove provided in the second dial fitting hole for the second stopper to be fitted into the moving groove and moved, wherein the moving groove is disposed to correspond to a portion except the moving bar fitting hole and a peripheral portion thereof.

4. The molded case circuit breaker of claim 3, wherein the fitting groove is disposed to correspond to a lower side of the moving groove, and when the dial rotates with the auxiliary cover being coupled to the upper cover, the second stopper is moved in a state of being fitted into the moving groove, and simultaneously, the first stopper is fitted into and fixed to the fitting groove.

* * * * *